343-700 MS AU 256 EX
2/6/79 XR 4,138,684

United States Patent [19]

Kerr

[11] 4,138,684

[45] Feb. 6, 1979

[54] LOADED MICROSTRIP ANTENNA WITH INTEGRAL TRANSFORMER

[75] Inventor: John L. Kerr, Neptune, N.J.

[73] Assignee: The United States of America as represented by the Secretary of the Army, Washington, D.C.

[21] Appl. No.: 796,289

[22] Filed: May 12, 1977

[51] Int. Cl.[2] ..... H01Q 1/38

[52] U.S. Cl. ..... 343/846; 343/700 MS

[58] Field of Search ..... 343/700 MS File, 708, 343/769, 846, 854, 853

[56] References Cited

U.S. PATENT DOCUMENTS 3,947,850 3/1976 Kaloi ..... 343/846

3,972,050 7/1976 Kaloi ..... 343/700 MS

OTHER PUBLICATIONS

Greiser, John, "Coplanar Stripline Antenna", Microwave Journal, Oct. 1976, pp. 47–49.

*Primary Examiner*—Craig E. Church
*Assistant Examiner*—David K. Moore
*Attorney, Agent, or Firm*—Nathan Edelberg; Jeremiah G. Murray; Bernard Franz

[57] ABSTRACT

A microstrip antenna design according to which the impedance matching transformer is contained in the area usually occupied entirely by the etched metal radiator.

10 Claims, 7 Drawing Figures

LOADED MICROSTRIP ANTENNA WITH INTEGRAL TRANSFORMER

FIELD OF THE INVENTION

This invention relates to microstrip antennas, and, more particularly, to an improvement of the antenna designs described in U.S. Pat. application Ser. No. 729,513, filed Oct. 4, 1976, now U.S. Pat. No. 4,060,810 issued Nov. 29, 1977, and assigned to the same assignee as is this instant invention.

BACKGROUND OF THE INVENTION

As is described in the U.S. Pat. No. 4,060,810, a microstrip antenna is a printed circuit device in which the radiating element is typically a rectangular patch of metal etched on one side of a dual-clad circuit board, with the size of the element being dependent upon the resonant frequencies desired and upon the dielectric constant of the circuit board material. It was there noted that in those instances where it was desired to combine a microstrip antenna operating at the L-band of frequencies with a horn radiator operating at the X-band of frequencies — for a parabolic dish reflector, for example —, the resultant construction could lead to a reduced efficiency of operation because of aperture blockage, unless the reflector were increased in size. This, however, made the combination fairly cumbersome and increased its manufacturing costs.

As was described, the microstrip antenna design of that application followed from a finding that the resonant frequency of a given size radiator decreased if a central portion of the etched metal element were removed. With its additional described finding that the size of the radiator could be reduced and yet still operate at the same resonant frequency, simplifications in microstrip antenna designs could be made — including the fabrication of a dual frequency arrangement in which an antenna operating at X-band was printed on the same dual-clad circuit board as an antenna operating at L-band, when the X-band radiator was positioned in the portion of the etched metal element removed from the L-band radiator. By thus being able to reduce the size of the microstrip antenna for a given frequency, it was noted that the overall antenna feed could be reduced in dimension, so as to enable the dish reflector, for example, to be similarly decreased in size, while maintaining the same degree of aperture blockage. As was additionally noted, the techniques described therein were applicable not only to dual-frequency arrangements, but to multiple frequency capability arrangements, as well.

SUMMARY OF THE INVENTION

As will become clear hereinafter, the microstrip antenna design of the instant invention differs from that described in the U.S. Pat. No. 4,060,810 case by incorporation of the impedance matching transformer in the area usually occupied entirely by the etched metal radiator. Experimentation has shown that the pattern performance of this modified microstrip antenna is almost identical to that of the aforementioned application, with the voltage-standing-wave-ratio bandwidths also being substantially similar. With the integral transformer arrangement of the present invention, however, it was determined that the size of the entire L-band circuit could be reduced, thereby providing additional space for feed lines in a planar array antenna configuration.

Additionally, it was determined that the reduced size which results from integrating the impedance matching transformer in the etched metal area proved especially advantageous in reducing possible pattern distortion in dual-frequency antenna arrangements of the type wherein an X-band microstrip antenna was printed on the same dual-clad circuit board which operated at L-band frequency.

BRIEF DESCRIPTION OF THE DRAWING

These and other features of the present invention will be more clearly understood from a consideration of the following description, taken in connection with the accompanying drawing, in which.

DETAILED DESCRIPTION OF THE DRAWING

Figure 1:
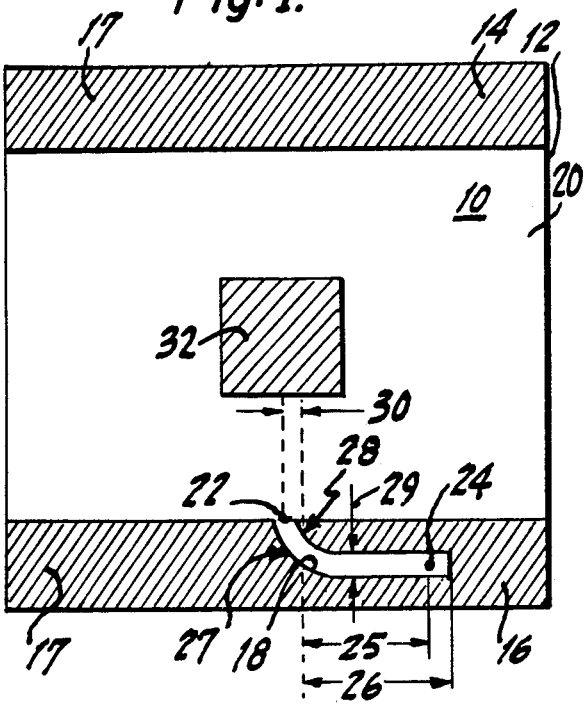
FIG. 1 shows a microstrip antenna constructed in accordance with the teachings of the U.S. Pat. No. 4,060,810.

In FIG. 1, the microstrip antenna of U.S. Pat. No. 4,060,810 is shown as comprising a circuit board 12, the back side of which (not shown) is clad entirely of a metal material, typically copper. In conventional constructions, the front side of the circuit board is clad of like material, except in the areas 14 and 16, where the metal is etched away to reveal the dielectric material 17 underneath. A section of metal 18 extends from the rectangular metal patch 20 so formed, to operate as a microstrip transformer in matching the impedance at the input to the patch 22 to the impedance at the signal input jack 24, usually the output from a coaxial cable coupled through the back side of the circuit board 12.

In one embodiment of the microstrip antenna there described, a circuit board clad with copper 1-½ mils thick overlying a ⅛ inch thick Duroid dielectric was employed for radiating in the L-band of frequencies. When constructed 4.655 inches on a side, and with the etched areas 14, 16 extending approximately 0.988 inches each, the microstrip antenna exhibited a resonant frequency of some 1370 MHz. The dimensions of the microstrip transformer 18, illustrated by the reference numerals 25–30, were as follows:

Length 25 — 0.772 inches
Length 26 — 0.872 inches
Arc 27 — 0.600 inch radius
Arc 28 — 0.400 inch radius
Width 29 — 0.200 inches
Distance 30 — 0.500 inches, measured with respect to the vertical center line of the circuit board 12.

In accordance with the invention described in U.S. Pat. No. 4,060,810, the resonant frequency of this described radiator decreased if a central portion of the rectangular metal patch 20 were removed. For example, it was noted that if a 1-inch square area were removed at the center of the circuit board 12, then the resonant frequency would be lowered by slightly in excess of 9%, as compared with an unloaded microstrip antenna. It was further described how if the central area, shown as 32 in the present FIG. 1, were so removed as to include the dielectric material beneath it and the copper cladding on the back side of the board 12 as well (thereby resulting in a 1-inch square hole completely through the circuit board 12), then the resonant frequency of the microstrip antenna would be lowered by approximately another 1%. It was further noted that the loaded microstrip antenna design, as shown, made possible a substantial reduction in the size of the rectangular metal patch 20 required for a given resonant frequency — for example, that the 9% decrease in resonant frequency which resulted from using a 1-inch square area of removed metal 32 would be offset by reducing the height between the areas 14, 16 by some 12%.

Figure 2:
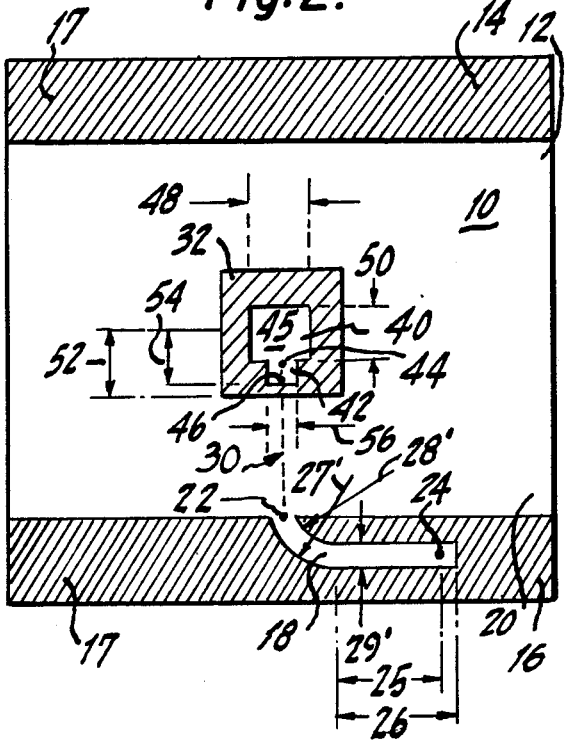
FIG. 2 is a dual-frequency microstrip antenna illustrating the concepts described in that case.

In addition to the advantages of lowered resonant frequency for a given size and reduced size for a given resonant frequency, the loaded microstrip antenna was described as making possible new embodiments. One example (FIG. 2 herein) was a dual frequency microstrip antenna in which the rectangular metal patch 45 of an X-band microstrip antenna 40 was printed onto the 1-inch square loading patch 32 of the L-band microstrip antenna of FIG. 1. All dimensions were the same as with respect to FIG. 1, except that the dielectric material was selected of 1/16 inch thickness instead of ⅛ inch thickness. The impedance transformer for the X-band radiator is shown at 42, to match the impedance at the input point 44 of the patch 45 to the impedance of the coaxial cable which applies its signal via the back of the same dual-clad board 12, by way of terminal 46. In this dual-frequency embodiment, the length of the radiator 40 was represented by the reference numeral 48, its width by the reference numeral 50, and with reference numerals 52, 54 and 56 illustrating other selected dimensions for X-band operation. In an actual construction of a 9500 MHz radiator, the following dimensions were employed:

Length 48 — 0.610 inches
Width 50 — 0.400 inches
Dimension 52 — 0.450 inches
Dimension 54 — 0.405 inches
Dimension 56 — 0.070 inches (equi-distant about the vertical axis of the L and X-band radiators).
Arc 27′ — 0.535 inch radius
Arc 28′ — 0.465 inch radius
Width 29′ — 0.070 inches It was also pointed out that, although like polarization was illustrated, orthogonal polarization could be obtained by etching the X-band radiator to be rotated 90° on the 1-inch square patch 32. It was further noted that the impedance transformer 42 could be curved, just as the impedance transformer 18, although the orientation selected was concerned primarily only with keeping the extension physically on the circuit board employed.

As can be shown, the design of the unloaded microstrip antenna of FIG. 1 (i.e. without the removal of the etched metal area 32), covers some 3.279 inches of clad metal height for the dimensions indicated (4.655 − 0.988 − 0.988 + 0.600). Experimentation has shown that an almost identical pattern performance and substantially similar voltage-standing-wave ratio bandwidth could be obtained by making the impedance matching transformer 18 an integral part of the etched metal radiator, while at the same time substantially reducing the overall height so as to provide additional space for feed line usage in a planar array arrangement. Such a modified L-band microstrip antenna is shown in FIG. 3, again employing a circuit board clad with copper 1-½ mils thick overlying a ⅛ inch thick Duroid dielectric and of 4.655 inches on a side.

Figure 3:
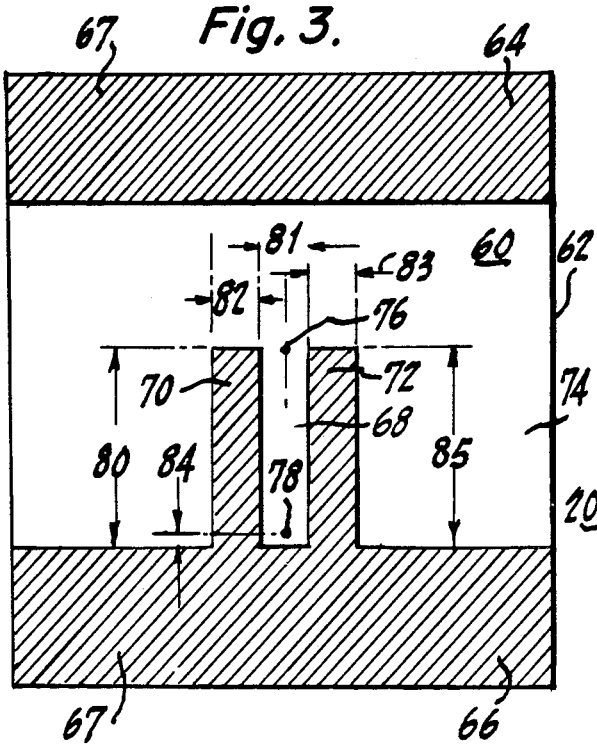
FIG. 3 shows a microstrip antenna constructed in accordance with the present invention.

As with the microstrip antenna of FIG. 1, the microstrip antenna 60 of FIG. 3 is shown as comprising a circuit board 62, the back side of which (not shown) is clad entirely of copper material. Also, the front side of the circuit board is clad of like material, except in the areas 64 and 66 where the metal is etched away to reveal the dielectric material 67 underneath. As contradistinct to the microstrip antenna of FIG. 1, wherein the microstrip transformer 18 extends from the rectangular metal patch 20 so formed into the unclad area 16, the microstrip transformer 68 of FIG. 3 is formed between the extension of a pair of unclad, substantially rectangular areas 70, 72, extending from the side area 66 inwardly of the metal patch 74. As with the FIG. 1 arrangement, the microstrip transformer 68 serves to match the impedance at the input to the patch 76 to the impedance at the signal input jack 78 — again, usually the output from a coaxial cable coupled through the back side of the circuit board 62.

The dimensions of the microstrip transformer 68 and the two extension areas 70, 72, illustrated by the reference numerals 80–84, are as follows:

Length 80 — 1.600 inches
Length 85 — 1.600 inches
Width 81 — 0.380 inches
Width 82 — 0.435 inches
Width 83 — 0.435 inches
Distance 84 — 0.040 inches (coincident with the vertical center line of the impedance transformer 68).

With the etched areas 64, 66 extending approximately 0.918 inches each, the microstrip antenna of FIG. 3 exhibited the same pattern performance and a substantially similar voltage-standing-wave-ratio bandwidth as the microstrip antenna of FIG. 1, but occupying an active height of (4.655 − 0.918 − 0.918) or 2.918 inches, a height reduction of some 14% as compared with the FIG. 1 configuration.

Figure 4:
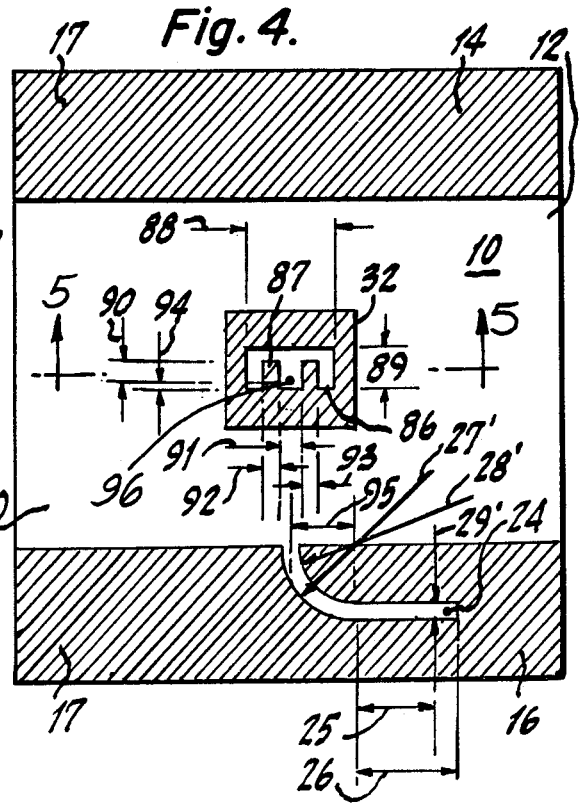
FIG. 4 shows a dual-frequency microstrip antenna illustrating the concepts of the integral transformer described herein.

The configuration of FIG. 4 shows a dual frequency microstrip antenna which incorporates both the 1-inch square removal area of the U.S. Pat. No. 4,060,810, along with the integral transformer arrangement of the present case. Experimentation has found that not only is there a reduction in the height of the rectangular patch 60 comprising the metal radiator (as described with respect to FIG. 3), but there is also a considerable reduction in any distortion which might be created, for example, with the configuration of FIG. 2, of the X-band E-plane pattern due to the relatively small spacing between the end of the X-band matching transformer 42 and the L-band radiator 10. That is, not only does the use of the integral transformer permit a reduction in overall height so as to make additional space available for transmission feed lines in a planar array, but the reduction in height also increases the physical separation between the X-band and L-band radiators 40, 20 so as to reduce possible interfering distortions. In FIG. 4, with the dielectric selected of 1/16 inch thickness instead of ⅛ inch thickness in order for operation at the higher X-band frequencies, the following dimensions were employed in a construction of an X-band microstrip antenna 86 imprinted onto the 1-inch square loading patch 32 of the L-band microstrip antenna of FIG. 1:

Length 88 — 0.600 inches
Width 89 — 0.330 inches
Length 90 — 0.250 inches

Width 91 — 0.125 inches
Width 92 — 0.060 inches
Width 93 — 0.060 inches
Distance 94 — 0.045 inches
Arc 27' — 0.535 inch radius
Arc 28' — 0.465 inch radius
Width 29' — 0.070 inches
Length 25 — 0.872 inches
Length 26 — 0.972 inches
Distance 95 — 0.500 inches With these dimensions, it will be seen that not only is there increased spacing between the X-band radiator 86 and the L-band radiator 20 (0.335 inches in FIG. 4 vs. 0.050 inches in FIG. 2), but that the width of the X-band radiator 86, 0.330 inches, is some 18% less than the width of the X-band radiator 40, 0.400 inches — thereby further spacing the distance between the dual frequency radiators, to additionally reduce possible distortion and provide added space for planar array feed lines.

Testings have shown that with a four-foot parabolic dish reflector having a "focal length to diameter" ratio of 0.375, the L-band portion of the dual frequency feed of FIG. 4 exhibits −18 and −20 dB E- and H- plane sidelobes, while the X-band portion of the feed provides E- and H- plane sidelobes of −20 and −24 dB, respectively. As will be readily apparent to those skilled in the art, such performance is quite good and compares quite favorably with alternative antenna designs.

(Although it will be noted that other arrangements might be provided to increase the spacing between an X-band radiator imprinted on an L-band microstrip antenna constructed in accordance with the invention of U.S. Pat. No. 4,060,810 to reduce possible distortion, (e.g., feeding the signal from the coaxial cable through the back side of the rectangular patch off-center), the described configuration with the integral transformer contained in the area usually occupied entirely by the etched metal radiator offers the advantage of extending the number of planar elements one could construct on the same circuit board.)

Figure 5A:
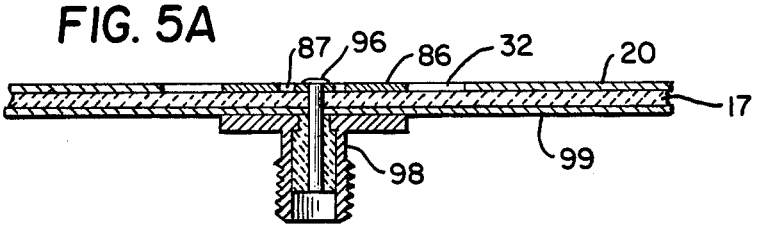
FIGS. 5A, 5B and 5C are cross section views of embodiments of FIG. 4.

An enlarged cross section view of the embodiment of the dual frequency configuration in which both radiators are printed on a single board is shown in FIG. 5A taken along lines 5—5 of FIG. 4. The view is broken to highlight the center. In this embodiment the dielectric material is 1/16 inch thick across the entire board, and likewise the metal 99 on the back side covers the entire board. The L-band radiator 20 has a 1-inch square 32 removed only from the metal on the front side. A coaxial cable jack 98 for the X-band radiator 86 has the center soldered to the microstrip transformer at point 96, and the mounting base of the jack is soldered to the back metal 99. There is a similar jack for the L-band radiator which does not appear in FIG. 5A because of the viewing direction.

Figure 5B:
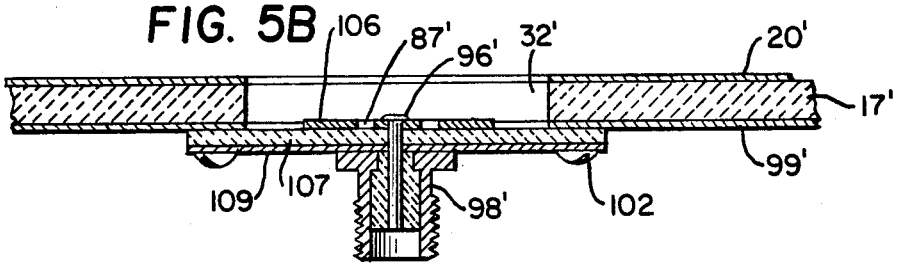

Another embodiment of the dual frequency configuration is shown in cross section in FIG. 5B also taken along lines 5—5 of FIG. 4. This embodiment makes use of the form of the L-band radiator as described in U.S. Pat. No. 4,060,810 in which the one-inch square hole 32' in the center is cut not only in the front metal, but also through the dielectric material 17' and the back metal 99'. This makes it possible for the dielectric material 17' to be of the desired ⅛ inch thickness. The X-band radiator is formed on a separate small square circuit board having dielectric material 107 which is 1/16 inch thick. The metal 109 clad on the back side likewise covers the entire square. The X-band radiator 106 formed by etching the front side metal has the same dimensions as described for FIG. 4. The small board is placed so that the X-band radiator is aligned with the hole in the center of the L-band radiator as shown in FIG. 4. The two boards are then affixed together. One manner of affixing is to make the small board larger than the 1-inch square hole 32' and have the insulation 107 bear against the ground plane 99' of the large board, and then fasten them together with screws or solder on the back.

Figure 5C:
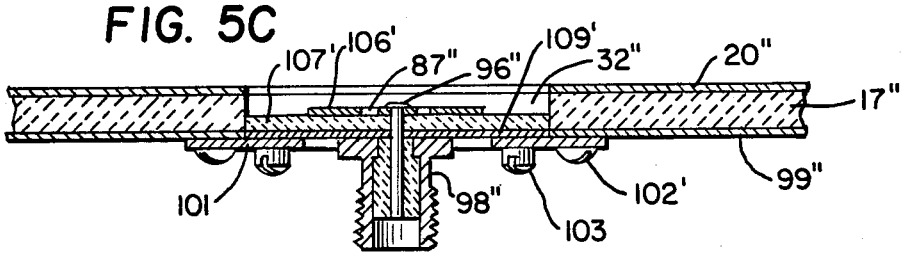

Still another embodiment of the dual frequency configuration is shown in cross section in FIG. 5C also taken along lines 5—5 of FIG. 4. As in FIG. 5B, this embodiment makes use of the form of the L-band radiator in which the one-inch square hole 32' in the center is cut not only in the front metal, but also through the dielectric material 17" and the back metal 99". This again makes it possible for the dielectric material 17" to be of the desired ⅛ inch thickness. Again, the X-band radiator is formed on a separate square circuit board having dielectric material 107' which is 1/16 inch thick. The metal 109' clad on the back side likewise covers the entire square. Again the X-band radiator on the front side has the same dimensions as described for FIG. 4. However, the small circuit board is made one-inch square and placed inside the hole 32" of the large board so that the metal ground planes are adjacent in the same plane, and the two boards are affixed together. This may be done by soldering, or as shown in FIG. 5C with a metal clamp 101 in the form of a square plate with a square hole, and the screws 102' and 103 of insulating material. Four screws 102' at the corners attach the clamp 101 to the large board, and four screws 103 attach it to the small board.

While there have been described what are considered to be preferred embodiments of the present invention, it will be readily apparent to those skilled in the art that modifications may be made without departing from the teachings herein of providing a microstrip radiator with an integral transformer etched in the same circuit board area. For example, whereas the configuration of FIG. 4 shows a dual frequency microstrip antenna providing like polarizations of radiated signals, orthogonal polarization could be obtained by etching the X-band radiator 86 to be rotated 90° on the patch 32. For at least such reason, therefore, reference should be had to the claims appended hereto in determination of the scope of this invention.

I claim:

1. In a microstrip antenna configuration, apparatus comprising:

circuit board means of dielectric material having metallic ground plane means on one side thereof;

a first radiating element in the form of a first patch of metal etched on the opposite side of said circuit board means, said patch being continuous thereacross except for the removal of a portion in the central region thereof;

wherein there is additionally included a second radiating element in the form of a second patch of metal superimposed on said opposite side of said circuit board means in the region of removal of a portion of said first radiating element;

first and second feed means coupled respectively to said first and second radiating elements at respective points along a center line of each, to operate the first radiating element in a first frequency band and the second radiating element in a higher second frequency band;

wherein said second feed means includes a microstrip transformer etched on said opposite side of said circuit board means continuous with the second patch forming the second radiating element, the microstrip transformer extending inwardly in the second patch along the center line and formed by the removal of two portions of the patch on the two sides thereof so that each portion removed has the transformer on one side and a remaining portion of the patch on the other side; and wherein a signal input jack is connected to the microstrip transformer at a connection point near the outer end thereof.

2. The apparatus of claim 1, wherein removal of a portion in the central region of the first patch provides a loading effect so that the dimension along the center line having the feed point is reduced for a given resonant first frequency of the first radiating element;

wherein the complete rectangle which includes the second patch the microstrip transformer and said portions removed has a first dimension along said center line which is shortened for a given resonant second frequency of the second radiating element because of the loading effect of said removed portions as compared to a complete rectangular patch, and said first dimension is less than the dimension perpendicular thereto;

wherein the dimensions of the microstrip transformer for the second patch are selected so as to substantially match the impedance present at said connection point to the impedance of said second radiating element.

3. The apparatus of claim 2, wherein said circuit board means comprises a single circuit board of uniform thickness of the dielectric materials, with both the first and the second patches formed thereon.

4. The apparatus of claim 3, wherein said portions removed of the second patch extend from one side of the second patch by a distance greater than one half of said first dimension, so that the second radiating element is effectively fed between the center and the side opposite said one side.

5. The apparatus of claim 3, wherein said first and second patches are oriented to provide like polarizations of signals radiated thereby.

6. The apparatus of claim 3, wherein said first and second patches are oriented to provide orthogonal polarizations of signals radiated thereby.

7. The apparatus of claim 2 wherein said circuit board means comprises a first circuit board with said first radiating element and a second circuit board with said second radiating element;

wherein the dielectric material of the first and second circuit boards are of thicknesses selected in accordance with frequencies to be radiated by the first and second radiating elements respectively;

said first circuit board insulating material and ground planes being continuous except for removal of a central portion of each coextensive with the removal of the patch portion etched thereon for the first radiating element;

wherein said second circuit board is affixed to said first circuit board in a manner to align said second radiating element with said central portion of said first circuit board.

8. The apparatus of claim 7, wherein said portions removed of the second patch extend from one side of the second patch by a distance greater than one half of said first dimension, so that the second radiating element is effectively fed between the center and the side opposite said one side.

9. The apparatus of claim 7, wherein said first and second patches are oriented to provide like polarizations of signals radiated thereby.

10. The apparatus of claim 7, wherein said first and second patches are oriented to provide orthogonal polarizations of signals radiated thereby.

* * * * *